US006764555B2

(12) United States Patent
Hiramatsu et al.

(10) Patent No.: US 6,764,555 B2
(45) Date of Patent: Jul. 20, 2004

(54) HIGH-STRENGTH AUSTENITIC STAINLESS STEEL STRIP HAVING EXCELLENT FLATNESS AND METHOD OF MANUFACTURING SAME

(75) Inventors: Naoto Hiramatsu, Shin-Nanyo (JP); Kouki Tomimura, Shin-Nanyo (JP); Hiroshi Fujimoto, Shin-Nanyo (JP); Kenichi Morimoto, Shin-Nanyo (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 10/004,919

(22) Filed: Dec. 3, 2001

(65) Prior Publication Data

US 2002/0102178 A1 Aug. 1, 2002

(30) Foreign Application Priority Data

Dec. 4, 2000 (JP) ..... 2000-368534

(51) Int. Cl.[7] ..... C22C 38/44; C21D 8/02
(52) U.S. Cl. ..... 148/325; 148/327; 148/608
(58) Field of Search ..... 148/325, 327, 148/608

(56) References Cited

U.S. PATENT DOCUMENTS 4,849,166 A * 7/1989 Hoshino et al. ..... 420/58
5,171,384 A * 12/1992 Igawa et al. ..... 148/325
5,429,688 A * 7/1995 Barbosa et al. ..... 148/327

* cited by examiner

*Primary Examiner*—Deborah Yee
(74) *Attorney, Agent, or Firm*—Webb Ziesenheim Logsdon Orkin & Hanson. P.C.

(57) ABSTRACT

A high-strength austenitic stainless steel strip exhibiting excellent flatness with Vickers hardness of 400 or more has the composition comprising: C up to 0.20 mass %, Si up to 4.0 mass %, Mn up to 5.0 mass %, 4.0–12.0 mass % Ni, 12.0–20.0 mass % Cr, Mo up to 5.0 mass %, N up to 0.15 mass % and the balance being Fe except inevitable impurities having a value Md(N) in a range of 0–125 defined by the formula Md(N)=580-520C-2Si-16Mn-16Cr-23Ni-26Cu-300N-10Mo. The material has a dual-phase structure of austenite and martensite involving a reverse-transformed austenite at a ratio of 3 vol. % or more. The material is manufactured by solution-heating a steel strip having the above composition, cold-rolling the steel strip to generate a deformation-induced martensite, and then re-heating at 500–700° C. to induce a phase reversion from martensite to at least 3 vol. % austenite. The reversion effectively flattens the steel strip.

4 Claims, No Drawings

HIGH-STRENGTH AUSTENITIC STAINLESS STEEL STRIP HAVING EXCELLENT FLATNESS AND METHOD OF MANUFACTURING SAME

BACKGROUND OF THE INVENTION

The present invention relates to a high-strength metastable austenitic stainless steel strip composed of a dual-phase structure of austenite and martensite exhibiting excellent flatness with Vickers hardness of 400 or more. The invention also relates to a manufacturing method thereof.

Martensitic, work-hardened or precipitation-hardened stainless steel has been typically used as a high-strength material with a Vickers hardness of 400 or more.

Martensitic stainless steel such as SUS 410 or SUS420J2 is hardened by quenching from a high-temperature austenitic phase to induce martensite transformation. Since the steel material is adjusted to a Vickers hardness of 400 or more by heat-treatment such as quenching-tempering, its manufacturing process necessitates such the heat-treatment. The steel strip unfavorably reduces its toughness after quenching and changes its shape due to the martensite transformation. These disadvantages put considerable restrictions on manufacturing conditions.

Work-hardened austenitic stainless steel such as SUS 301 or SUS 304 is often used instead, in the case where deviation of shape causes troubles on usage. The work-hardened austenitic stainless steel has an austenitic phase in a solution-treated state and generates a deformation-induced martensite phase effective for improvement of strength during cold-rolling thereafter.

Although the surface of a steel strip is flattened by cold-rolling, the dependency of hardness on a rolling temperature is great, and the surface flatness varies irregularly along a lengthwise direction or rolling direction of the steel strip. As a consequence, it is difficult to uniformly flatten the steel strip under stable conditions by cold-rolling from commercial point of view.

A degree of transformation from austenite to deformation-induced martensite depends on a rolling temperature, even if a stainless steel strip such as SUS 301 or SUS 304 is cold-rolled at the same reduction ratio. When the steel strip is cold-rolled at a high temperature, generation of the deformation-induced martensite is suppressed, resulting in poor hardness of the cold-rolled steel strip. Conversely, a lower rolling temperature accelerates transformation to deformation-induced martensite and raises hardness of the cold-rolled steel strip. Increasing hardness causes an increase of deformation resistance, and so makes it difficult to flatten the steel strip in a uniform manner.

SUMMARY OF THE INVENTION

The present invention provides a high-strength austenitic stainless steel strip exhibiting excellent flatness with Vickers hardness of 400 or more. Improved flatness is attained by a volumetric change during the phase reversion from deformation-induced martensite to austenite so as to suppress shape deterioration caused by martensitic transformation, rather than flattening the steel strip while in a martensitic phase.

The high-strength austenitic stainless steel strip proposed by the present invention has a composition consisting of C up to 0.20 mass %, Si up to 4.0 mass %, Mn up to 5.0 mass %, 4.0–12.0 mass % Ni, 12.0–20.0 mass % Cr, Mo up to 5.0 mass %, N up to 0.15 mass %, optionally at least one or more of Cu up to 3.0 mass %, Ti up to 0.5 mass %, Nb up to 0.50 mass %, Al up to 0.2 mass %, B up to 0.015 mass %, REM (rare earth metals) up to 0.2 mass %, Y up to 0.2 mass %, Ca up to 0.1 mass % and Mg up to 0.10 mass %, and the balance being Fe plus inevitable impurities with the provision that a value Md(N) defined by the formula (1) is in a range of 0–125.

$$Md(N)=580-520C-2Si-16Mn-16Cr-23Ni-26Cu-300N-10Mo \quad (1)$$

The steel strip has a dual-phase structure of austenite and martensite, which involves a reversed austenitic phase at a ratio more than 3 vol. %.

The newly proposed austenitic stainless steel strip is manufactured as follows: A stainless steel strip having the properly controlled composition is solution-treated, cold-rolled to generate a deformation-induced martensite phase, and then re-heated at 500–700° C. to induce a phase reversion, whereby an austenitic phase is generated at a ratio of 3 vol. % or more in a matrix composed of the deformation-induced martensite. When the steel strip is treated in this manner to achieve the austenitic phase reversion of 3 vol. % or more and then placed under a load of 785 Pa or more, the flatness of the strip is improved.

DETAILED DESCRIPTION OF INVENTION

The inventors have researched and examined, from various aspects, effects of conditions for manufacturing a metastable austenitic stainless steel strip, which generates deformation-induced martensite during cold-rolling, on hardness and flatness of the steel strip. As a result of the research, the inventors have found that heat-treatment to promote reversion from deformation-induced martensite to austenite causes a volumetric change of the steel strip which is effective for improving flatness. High strength and excellent flatness are gained by properly controlling the composition of the steel as well as controlling the conditions for reversion. In the specification of the present invention, the wording "a steel strip" of course involves a steel sheet, and the same reversion to austenite is realized during heat-treatment of a steel sheet.

The composition of the austenitic stainless steel together with the conditions of reversion will become apparent from the following explanation.

C up to 0.20 mass %

C is an austenite former, which hardens a martensite phase and also lowers a reversion temperature. As the reversion temperature decreases, reversion to austenite is more easily controlled at a proper ratio suitable for improvement of flatness and hardness. However, precipitation of chromium carbides at grain boundaries is accelerated in a cooling step after solution-treatment or during aging as the C content increases. Precipitation of chromium carbides causes degradation of intergranular corrosion cracking resistance and fatigue strength. In this sense, an upper limit of C content is determined at 0.20 mass %, so as to inhibit precipitation of chromium carbides by conditions of heat-treatment and a cooling speed.

Si up to 4.0 mass %

Si is a ferrite former, which dissolves in a martensite matrix, hardens the martensitic phase and improves strength of a cold-rolled steel strip. Si is also effective for age-hardening, since it promotes strain aging during aging-treatment. However, excessive additions of Si cause high-temperature cracking and also various troubles in the manufacturing process, so that an upper limit of the Si content is determined at 4.0 mass %.

Mn up to 5.0 mass %

Mn is effective for suppressing generation of δ-ferrite in a high-temperature zone. An initiating temperature for reversion falls as the Mn content increases, so that a ratio of reversed austenite can be controlled with ease. However, excessive addition of Mn above 5.0 mass % unfavorably accelerates generation of deformation-induced martensite during cold-rolling, and makes it impossible to use the reversion for improvement of flatness.

Ni: 4.0–12.0 mass %

Ni inhibits generation of δ-ferrite in a high-temperature zone, the same as Mn, and lowers an initiating temperature for reversion, the same as C. Ni also effectively improves precipitation-hardenability of a steel strip. These effects become apparent at a Ni content not less than 4.0 mass %. However, excessive additions of Ni above 12.0 mass % unfavorably accelerate generation of deformation-induced martensite during cold-rolling and thus makes it difficult to induce the reversion necessary for flattening.

Cr: 12.0–20.0 mass %

Cr is an alloying element used for improvement of corrosion resistance. Corrosion resistance is intentionally improved at a Cr content of 12.0 mass % or more. However, excessive additions of Cr cause too much generation of δ-ferrite in a high-temperature zone and requires the addition of austenite formers such as C, N, Ni, Mn and Cu. An increase of the austenite formers stabilizes the austenitic phase at room temperature and makes it difficult to generate deformation-induced martensite during cold-rolling. As a result, a steel strip after being aged exhibits poor strength. In this sense, an upper limit of Cr content is determined at 20.0 mass %, in order to avoid an increase of the austenite formers.

Mo up to 5.0 mass %

Mo effectively improves corrosion resistance of the steel strip and promotes dispersion of carbides as fine particles during reversion. In reversion treatment useful for flattening a steel strip, a re-heating temperature is determined at a level higher than a temperature for conventional aging treatment. Although elevation of the re-heating temperature accelerates the release of strains, abrupt release of strains is suppressed by the addition of Mo. Mo generates precipitates which are effective in improving strength during aging. Mo also inhibits a decrease of strength at a reversion temperature higher than a conventional aging temperature. These effects become apparent at a Mo content of 1.5 mass % or more. However, excessive additions of Mo above 5.0 mass % accelerate generation of δ-ferrite in a high-temperature zone.

N up to 0.15 mass %

N is an austenite former, which lowers an initiating temperature for reversion, the same as C. Reversed austenite can be controlled at a ratio suitable for flatness and strengthening with ease by the addition of N at a proper ratio. However, since an excessive addition of N causes the occurrence of blowholes during casting, an upper limit of N content is determined at 0.15 mass %.

Cu up to 3.0 mass %

Cu is an optional alloying element acting as an austenite former, which lowers an initiating temperature for reversion and promotes age-hardening during reversion. However, excessive additions of Cu above 3.0 mass % cause poor hot-workability and the occurrence of cracking.

Ti up to 0.50 mass %

Ti is an optional alloying element, which promotes age-hardening and improves strength during reversion. However, excessive additions of Ti above 0.50 mass % cause the occurrence of scratches on the surface of the slab and troubles in the manufacturing process.

Nb up to 0.50 mass %

Nb is an optional alloying element, which improves strength during reversion but degrades hot-workability of the steel strip. In this sense, Nb content is limited to 0.50 mass % or less.

Al up to 0.2 mass %

Al is an optional alloying element, which serves as a deoxidizing agent in a steel-making step and remarkably reduces type-A inclusions, harmful for press-workability. The effects of Al are saturated at 0.2 mass %, and excessive additions of Al cause other troubles such as the occurrence of surface flaws.

B up to 0.015 mass %

B is an optional alloying element effective for inhibiting the occurrence of edge cracks, which are derived from a difference of deformation resistance between δ-ferrite and austenite at a hot-rolling temperature, in a hot-rolled steel strip. However, excessive additions of B above 0.015 mass % cause generation of low-melting boride and somewhat deteriorates hot-workability.

Each of REM, Y, Ca and Mg is an optional alloying element, which improves hot-workability and oxidation resistance. Such the effects are saturated at 0.2 mass % REM, 0.2 mass % Y, 0.1 mass % Ca and 0.1 mass % Mg, respectively, and excessive additions of these elements worsen the cleanliness of the steel.

REM (rare earth metals) up to 0.2 mass %

Y up to 0.2 mass %

Ca up to 0.1 mass %

Mg up to 0.1 mass %

The newly proposed steel strip further includes P, S and O other than the above-mentioned elements. P is an element effective for solution-hardening but harmful for toughness, so that an upper limit of P content is preferably determined at a conventionally allowable level of 0.04 mass %. S content shall be controlled to a lowest possible level, since S is a harmful element which causes occurrence of ear cracks during hot-rolling. The harmful influence of S can be inhibited by addition of B, so that allowable S content is preferably determined at 0.02 mass % or less. O generates nonmetallic oxide inclusions, which worsens the cleanliness of the steel and harms press-workability and bendability. Hence, the O content is preferably controlled at a ratio of 0.02 mass % or less.

A value Md(N) defined by the formula of $$Md(N)=580-520C-2Si-16Mn-16Cr-23Ni-26Cu-300N-10Mo:0–125$$

According to the present invention, a shape of a stainless steel strip is flattened by volumetric change during re-heating to induce a phase reversion from deformation-induced martensite, which is generated by cold-rolling, to austenite. For such a reversion, a value Md(N) representing the stability of an austenitic phase against working is controlled in a range of 0–125 so as to generate deformation-induced martensite by cold-rolling after solution-treatment. The value Md(N) shall be not less than 0; otherwise cold-rolling at an extremely lower temperature, which is not adaptable for an industrial manufacturing process, would be necessary for generation of a martensite phase effective for improvement of strength. On the other hand, if the value Md(N) exceeds 125, an austemtic phase, which is generated during reversion, is re-transformed to martensite during cooling to room temperature, resulting in degradation of shape.

Phase reversion temperature: 500–700° C.

When a solution-treated steel strip is cold-rolled, deformation-induced martensite is generated by cold-rolling. The cold-rolled steel strip is then re-heated at a temperature to reverse the deformation-induced martensite phase to the austenite phase. If the re-heating temperature is lower than 500° C., the phase reversion progresses too slow from an industrial point of view. However, a re-heating temperature higher than 700° C. extremely accelerates the phase reversion and also softens the martensite phase, so that it is difficult uniformly provide a steel strip with a Vickers hardness of 400 or more. An excessively high re-heating temperature also causes degradation of corrosion resistance due to sensitization derived from carbide precipitation.

A ratio of reversed austenite: 3 vol. % or more

Volumetric change caused by a phase reversion from martensite to austenite results in a dimensional shrinkage of 10% or so, providing a steel strip flattened by shrinkage deformation. Although the shape of the steel strip collapses due to volumetric expansion caused by the transformation from austenite to martensite during cold-rolling, such collapse of the shape is eliminated by the shrinkage deformation during the reversion from deformation-induced martensite to austenite, which is realized by re-heating the cold-rolled steel strip. As a result of the experiments under various conditions, the inventors have found that a ratio of reversed austenite, which effects on flatness of a steel strip, is at least 3 vol. %.

A load applied to a steel strip during reversion: 785 Pa or more

A steel strip is held or fixed in a proper, flat state by application of a tension to a strip coil or by gravity of a steel strip itself during reversion. Flatness of the steel strip is further improved by reversion under the condition that a load is applied to the steel strip with a pressboard or the like, since the reversion progresses while the strip is restrained. In this case, a load is preferably of 785 Pa or more for each unit area, provides high-temperature strength at the reversion.

EXAMPLE

Each stainless steel sample of 250 kg having the composition shown in Table 1 was melted in a vacuum furnace, cast to an ingot, forged, hot-rolled to thickness of 4.0 mm, annealed 1 minute at 1050° C., and then pickled with an acid. After the steel strip was cold-rolled, it was re-heated 600 seconds to induce a phase reversion. Conditions for cold-rolling and re-heating are shown in Table 2. In Table 1, stainless steels Nos. 1–8 have compositions which satisfy conditions defined by the present invention, while stainless steels Nos. 9–14 have compositions outside of the present invention. In Table 2 Example Nos. 1–10 are those processed under conditions according to the present invention, while Example Nos. 11–19 are those processed under conditions outside of the present invention.

TABLE 1

CHEMICAL COMPOSITIONS OF STAINLESS STEELS USED IN EXAMPLES

| Steel | alloying elements (mass %) | | | | | | | | | | | | |
|---|---|---|---|---|---|---|---|---|---|---|---|---|---|
| No. | C | Si | Mn | P | S | Ni | Cr | Mo | N | O | others | Md(N) | Note |
| 1 | 0.125 | 1.43 | 2.80 | 0.025 | 0.015 | 5.89 | 18.02 | 0.98 | 0.089 | 0.0042 | | 7.0 | Inventive |
| 2 | 0.078 | 2.54 | 0.31 | 0.023 | 0.002 | 8.23 | 13.42 | 2.29 | 0.064 | 0.0058 | | 83.3 | Examples |
| 3 | 0.080 | 2.72 | 4.18 | 0.025 | 0.005 | 5.22 | 16.20 | 1.53 | 0.134 | 0.0068 | B:0.008 | 31.3 | |
| 4 | 0.058 | 1.35 | 1.26 | 0.026 | 0.006 | 6.80 | 12.48 | 2.30 | 0.078 | 0.0074 | Nb:0.28 | 124.5 | |
| 5 | 0.077 | 1.54 | 0.89 | 0.027 | 0.001 | 6.23 | 15.65 | 1.98 | 0.084 | 0.0084 | Al:0.14 | 84.0 | |
| 6 | 0.080 | 3.75 | 0.30 | 0.033 | 0.008 | 8.42 | 13.65 | 2.28 | 0.076 | 0.0079 | Ti:0.37, B:0.011 | 68.4 | |
| 7 | 0.082 | 2.73 | 0.37 | 0.028 | 0.018 | 5.91 | 12.59 | 1.52 | 0.115 | 0.0064 | Cu:1.67, Nb:0.31 | 95.5 | |
| 8 | 0.018 | 0.37 | 2.21 | 0.032 | 0.009 | 6.23 | 17.58 | 0.24 | 0.080 | 0.0077 | Ca:0.009, Y:0.05 | 83.6 | |
| 9 | 0.214 | 0.52 | 0.34 | 0.025 | 0.007 | 9.24 | 16.23 | 1.87 | 0.009 | 0.0056 | | −31.4 | Comparative |
| 10 | 0.084 | 0.45 | 0.42 | 0.024 | 0.009 | 4.56 | 16.25 | 0.86 | 0.008 | 0.0059 | Nb:0.23 | 152.8 | Examples |
| 11 | 0.185 | 0.87 | 5.28 | 0.029 | 0.007 | 6.76 | 14.05 | 1.89 | 0.011 | 0.0060 | Ti:0.34, Ca:0.005 | −4.9 | |
| 12 | 0.102 | 1.78 | 3.45 | 0.035 | 0.018 | 2.03 | 19.00 | 1.52 | 0.065 | 0.0045 | Ca:0.017 | 82.8 | |
| 13 | 0.128 | 0.24 | 1.98 | 0.019 | 0.022 | 7.00 | 12.89 | 4.23 | 0.123 | 0.0095 | Cu:1.87 | −13.8 | |
| 14 | 0.098 | 0.59 | 0.98 | 0.022 | 0.014 | 6.95 | 16.78 | 1.87 | 0.163 | 0.0088 | | 16.3 | |

The underlines mean figures out of the present invention.

TABLE 2

EFFECTS OF COLD-ROLLING AND REVERSION

| Ex. No. | Steel No. | a reduction ratio (%) | a temperature (° C.) of reversion | hardness HV1 | a ratio (vol. %) of reversed austenite | max. height (mm) of ears | Note |
|---|---|---|---|---|---|---|---|
| 1 | 1 | 85 | 525 | 483 | 4 | 1.8 | Inventive |
| 2 | 2 | 50 | 650 | 520 | 10 | 1.6 | Examples |
| 3 | 2 | 60 | 625 | 488 | 8 | 1.4 | |
| 4 | 3 | 64 | 574 | 462 | 6 | 1.2 | |
| 5 | 4 | 35 | 650 | 523 | 13 | 1.5 | |
| 6 | 5 | 60 | 650 | 563 | 14 | 1.1 | |
| 7 | 5 | 70 | 647 | 487 | 14 | 1.2 | |
| 8 | 6 | 70 | 689 | 423 | 18 | 1.2 | |
| 9 | 7 | 50 | 543 | 503 | 6 | 1.8 | |
| 10 | 8 | 45 | 674 | 423 | 22 | 0.9 | |
| 11 | 1 | 85 | 732 | 375 | 25 | 1.1 | Comparative |
| 12 | 2 | 50 | 480 | 391 | 2 | 5.9 | Examples |

TABLE 2-continued

EFFECTS OF COLD-ROLLING AND REVERSION

| Ex. No. | Steel No. | a reduction ratio (%) | a temperature (° C.) of reversion | hardness HV1 | a ratio (vol. %) of reversed austenite | max. height (mm) of ears | Note |
|---|---|---|---|---|---|---|---|
| 13 | 3 | 60 | 785 | 308 | 34 | 0.9 | |
| 14 | 9 | 90 | 650 | 386 | 2 | 6.7 | |
| 15 | 10 | 30 | 634 | 389 | 8 | 8.3 | |
| 16 | 11 | 85 | 589 | 305 | 4 | 0.8 | |
| 17 | 12 | 60 | 625 | 378 | 7 | 5.6 | |
| 18 | 13 | 85 | 653 | 356 | 2 | 6.5 | |
| 19 | 14 | 80 | 589 | 443 | 11 | 0.2 | |

The underlines mean figures out of the present invention.

It is noted from Table 2 that Inventive Examples Nos. 1–10 were stainless steel strips excellent in flatness with Vickers hardness of 400 or more in average. These steel strips had maximum height of ears controlled smaller than 2 mm after the reversion.

Comparative Examples Nos. 11–13 are stainless steels having compositions in the range defined by the present invention. But, reversed austenite was not sufficiently generated in the steel of Example No. 12, since a re-heating temperature was below 500° C. The steels of Example Nos. 11 and 13 had Vickers hardness below 400, since a re-heating temperature therefor was higher than 700° C.

Comparative Examples Nos. 14–18 are stainless steel strips, which exhibited poor flatness at Vickers hardness of 400 or more due to alloy compositions out of the range defined by the present invention. Especially, the steel of Example No. 15 was heavily deformed by re-transformation of reversed austenite to martensite during cooling due to a large Md(N) value above 125. The steel of Example No. 19 exhibited flaws scattered on its surface due to excessive N content, which were caused by blowholes originated during the steel making and casting steps.

Each steel strip was sized to a sheet of 200 mm in width and 300 mm in length, formed by cutting off both edges to a width of 10 mm, and pressed with a press board at a pressure shown in Table 3 in order to further improve flatness of the steel sheet. The steel sheet was re-heated 600 seconds to induce reversion under the pressed condition. Effects of a load applied to the steel sheet were investigated in relation with flatness of the re-heated steel sheet. Results are shown in Table 3, together with ratios of reversed austenite and averaged Vickers hardness (a load of 10 kg).

It is noted from Table 3 that any steel of Example Nos. 1–6 had Vickers hardness of 400 or more in average and height of ears suppressed below 1.0 mm due to application of the load during reversion. The relation of the applied load with the maximum height of ears demonstrates that a shape of a steel sheet is effectively flattened by application of a load of 785 Pa or more.

TABLE 3

EFFECTS OF APPLIED LOADS DURING REVERSION ON FLATNESS OF STEEL SHEETS

| Example No. | Steel No. | a reduction ratio (%) | a temperature (° C.) for reversion | an applied pressure (Pa) | hardness HV1 | a ratio (vol. %) of reversed austenite | Maximum height (mm) of ears |
|---|---|---|---|---|---|---|---|
| 1 | 1 | 85 | 550 | 2944 | 577 | 4 | 0.8 |
| 2 | 2 | 50 | 604 | 3925 | 520 | 11 | 0.3 |
| 3 | 2 | 60 | 625 | 785 | 477 | 15 | 0.8 |
| 4 | 3 | 60 | 650 | 1569 | 462 | 6 | 0.4 |
| 5 | 3 | 60 | 700 | 8635 | 415 | 32 | 0.6 |
| 6 | 4 | 64 | 610 | 4416 | 534 | 8 | 0.2 |

According to the present invention as above-mentioned, an austenitic stainless steel strip excellent in flatness of shape with Vickers hardness of 400 or more is manufactured by properly controlling its composition and conditions for reversion so as to disperse reversed austenite in a matrix of deformation-induced martensite at a predetermined ratio. The proposed steel strip is also good of corrosion resistance. Due to such the excellent properties, the austenitic stainless steel is useful as various spring materials or high strength materials in a broad industrial field, e.g. press plates, stainless frames, plate springs, flapper valves, metal gaskets, wrapping carriers, carrier plates, stainless mirrors, damper springs, disk brakes, brake master keys, steel belts and metal masks.

What is claimed is:

1. A high-strength austenitic stainless steel strip exhibiting excellent flatness with a Vickers hardness of 400 or more, having a composition comprising C up to 0.20 mass %, Si up to 4.0 mass %, Mn up to 5.0 mass %, 4.0–12.0 mass % Ni, 12.0–20.0 mass % Cr, 0.24–5.0 mass % Mo, N up to 0.15 mass % and the balance being Fe and inevitable impurities and having a value Md(N) in a range of 0–125 defined by a formula: Md(N)=580-520C-2Si-16Mn-16Cr-23Ni-26Cu-300N-10Mo, and having a dual-phase structure of austenite and martensite which includes a reversion austenitic phase at a ratio more than 3 vol. %.

2. The austenitic stainless steel strip defined in claim 1, which further contains at least one or more of Cu up to 3.0 mass %, Ti up to 0.5 mass %, Nb up to 0.50 mass %, Al up to 0.2 mass %, B up to 0.015 mass %, REM (rare earth metals) up to 0.2 mass %, Y up to 0.2 mass %, Ca up to 0.1 mass % and Mg up to 0.10 mass %.

3. A method of manufacturing a high-strength austenitic stainless steel strip excellent in flatness of shape with Vickers hardness of 400 or more, which comprises the steps of:

providing an austenitic stainless steel strip having a composition comprising C up to 0.20 mass %, Si up to 4.0 mass %, Mn up to 5.0 mass %, 4.0–12.0 mass % Ni, 12.0–20.0 mass % Cr, 0.24–5.0 mass % Mo, N up to 0.15 mass %, optionally at least one or more of Cu up to 3.0 mass %, Ti up to 0.5 mass %, Nb up to 0.50 mass %, Al up to 0.2 mass %, B up to 0.015 mass %, REM (rare earth metals) up to 0.2 mass %, Y up to 0.2 mass %, Ca up to 0.1 mass % and Mg up to 0.10 mass %, and the balance being Fe except inevitable impurities under the condition that a value Md(N) is 0–125 defined by a formula:

$$Md(N)=580-520C-2Si-16Mn-16Cr-23Ni-26Cu-300N-10Mo;$$

solution-heating said austenitic stainless steel strip;

cold-rolling said austenitic stainless steel strip to generate a deformation-induced martensite phase; and re-heating said cold-rolled austenitic stainless steel strip at 500–700° C. to induce a phase reversion, by which an austenitic phase is generated at a ratio of 3 vol. % or more in a matrix composed of said deformation-induced martensite phase.

4. The method of claim 3, including the step of applying a load of 785 Pa or more to the stainless steel.

* * * * *

UNITED STATES PATENT AND TRADEMARK OFFICE

CERTIFICATE OF CORRECTION

PATENT NO. : 6,764,555 B2
DATED : July 20, 2004
INVENTOR(S) : Hiramatsu et al.

It is certified that error appears in the above-identified patent and that said Letters Patent is hereby corrected as shown below:

Column 4,
Lines 23-28, paragraph beginning "Each of REM" and ending "cleanliness of the steel" should be placed before the paragraph beginning at Column 4, line 34 that begins with "The newly proposed steel strip".

Signed and Sealed this

Fifteenth Day of February, 2005

JON W. DUDAS
*Director of the United States Patent and Trademark Office*